US007571867B2

(12) United States Patent
Hu

(10) Patent No.: US 7,571,867 B2
(45) Date of Patent: Aug. 11, 2009

(54) SHOWERHEAD WITH TURBOCHARGER MECHANISM

(76) Inventor: Wei Hu, 6-12D, Yanguanghaibin City Science & Technology Park, No. 5 park South, Nanshan Shenzhen, Guangdong 518000 (CN)

( * ) Notice: Subject to any disclaimer, the term of this patent is extended or adjusted under 35 U.S.C. 154(b) by 88 days.

(21) Appl. No.: 11/776,542

(22) Filed: Jul. 11, 2007

(65) Prior Publication Data

US 2008/0315015 A1 Dec. 25, 2008

(30) Foreign Application Priority Data

Jun. 19, 2007 (CN) ..... 2007 2 0120924

(51) Int. Cl.

| | |
|---|---|
| ***B05B 1/34*** | (2006.01) |
| ***B05B 3/04*** | (2006.01) |
| ***B05B 3/16*** | (2006.01) |
| ***B67D 5/08*** | (2006.01) |
| ***F21V 33/00*** | (2006.01) |

(52) U.S. Cl. ..... 239/383; 239/71; 239/380; 239/381; 362/96

(58) Field of Classification Search ..... 239/265.11, 239/380, 381, 382, 383, 71; 290/43, 54; 362/96, 192

See application file for complete search history.

(56) References Cited

U.S. PATENT DOCUMENTS

| | | | | |
|---|---|---|---|---|
| 4,564,889 | A * | 1/1986 | Bolson | 362/192 |
| 4,616,298 | A * | 10/1986 | Bolson | 362/192 |
| 6,036,333 | A * | 3/2000 | Spiller | 362/192 |
| 2003/0147238 | A1 * | 8/2003 | Allen et al. | 362/192 |

* cited by examiner

*Primary Examiner*—Len Tran
*Assistant Examiner*—Ryan Reis
(74) *Attorney, Agent, or Firm*—Hamre, Schumann, Mueller & Larson, P.C.

(57) ABSTRACT

A showerhead with a turbocharger mechanism including a showerhead housing and a turbo-compressor unit is provided. The showerhead housing has a water inlet port for introducing a water flow, a case wall that gradually expands, and a water drainage panel. The turbo-compressor unit is accommodated in a housing chamber and includes a compressor compartment where the water flow is converted into a vortex flow, a turbo-pump impeller accommodated in the compressor compartment, and a turbo-generator capable of generating electric energy. The turbo-generator is electrically connected to an illumination means, so as to emit light beams. The present invention is provided with the turbocharger mechanism, so as to make use of the water flow flowing through the showerhead effectively to generate electricity for illumination.

5 Claims, 11 Drawing Sheets

SHOWERHEAD WITH TURBOCHARGER MECHANISM

BACKGROUND OF THE INVENTION

1. Field of Invention

The present invention relates to a liquid dispenser, and more particularly to a showerhead equipped with a turbocharger mechanism, so as to effectively make use of a water flow flowing through the showerhead to generate electricity for illumination or other applications.

2. Related Art

Currently, various types of showerheads are available in the market. In order to generate different water-spraying modes, such as pulsing, centering, showing, and misting, all showerheads are designed to have complicated structures and include a quite large number of internal parts. In the other aspect, all the complicated components must be accommodated in the sprinkle in a waterproof manner. Therefore, the manufacturing process is complex, and the related cost of the showerhead is high. Moreover, as so many precise components are packaged in a showerhead housing, it is impossible to ensure that all the critical parts are fitted in an ideal state in the practice. After the product has been used for a long time, different foreign substances are accumulated on the surface of the showerhead, thus blocking water drainage nozzles.

Most users expect that the showerhead is reliable and economic. It is certainly that the blocking caused by foreign substances accumulated on the showerhead is unacceptable. First, the foreign substances destroy the original good appearance of the showerhead. Moreover, this type of blocking may cause interruption of the required water spraying.

It is the worst experience that could be imagined for each person that the electricity is unexpectedly interrupted while showering. Especially, when showering in hotels or public bathrooms, the sudden blackness will cause a chaos. Usually, another illumination means (such as, a torch light) is used to provide illumination for showering. However, it is quite inconvenient and annoying for most users to go out of the bathroom to fetch the lamp.

Therefore, the showerhead is disadvantageous in terms of lacking of the emergency illumination means. Also, it is difficult to install this type of illumination means in the standard showerhead. In the other aspect, it is impossible to carry spare battery cells for providing power supply to the illumination means.

In fact, high-speed water showerhead and the like (e.g., sprayers) are widely applied in various fields, for example, in parks, public and personal lawns, and golf courses. A quite large amount of water resource has been wasted, and it is environmental protective to use this water resource. Therefore, it can be predicted that a source-saving showerhead with a simple structure will be welcomed in the market.

SUMMARY OF THE INVENTION

The present invention is directed to an innovative and improved showerhead with a turbo-generator unit, which has a simplified internal structure to ensure an extended service life of this type of showerhead.

The present invention is also directed to an innovative and improved showerhead with a turbo-generator unit, in which critical elements accommodated in a showerhead housing can be detached periodically for cleaning, so as to protect the showerhead nozzle from being blocked by foreign substances.

The present invention is further directed to an innovative and improved showerhead with a turbo-generator unit, which makes use of high-speed water flow to generate electric energy.

The present invention is further directed to an innovative and improved showerhead with a turbo-generator unit, in which the showerhead further includes an illumination means, and the illumination means is provided in the showerhead and powered by the generator to emit light.

The present invention is further directed to an innovative and improved showerhead with a turbo-generator unit. Therefore, the water flowing through the showerhead is first compressed by a turbo compressor mechanism, and is sprayed out from the nozzle at an extremely large speed and pressure.

The present invention is further directed to an innovative and improved showerhead equipped with an illumination means for emitting light beams of different colors. Thus, this type of showerhead can be used for illumination in case of unexpected electricity interruption.

The present invention is further directed to an innovative and improved showerhead, in which features of conventional showerheads are maintained, such as pulsing spraying and easy operation.

The present invention is further directed to an innovative and improved showerhead, in which the above object is achieved without using complicated structure or expensive components.

Therefore, in order to achieve the above objectives, the showerhead with a turbocharger mechanism according to the present invention includes:

a showerhead housing, including a case and a water drainage panel, wherein the case has a case water inlet port for introducing a water flow, and a case wall that gradually expands; the water drainage panel has a water spray nozzle disposed thereon and is disposed at a most bottom end of the case and hermetically connected with the case;

a turbo-compressor unit, accommodated in a housing chamber, wherein the turbo-compressor unit includes:

a compressor compartment, having a compressor compartment water inlet port communicated with the case water inlet port, so as to convert the water flow into a vortex flow to push a turbo-pump impeller, so that the water is discharged from a compressor compartment water exit; and a turbo-pump impeller, rotatably accommodated in the compressor compartment; and a turbo-generator, provided in the housing chamber, and including a generator and a generator driven shaft coaxially connected to the turbo-pump impeller; wherein when the turbo-pump impeller is driven by the vortex flow, the turbo-pump impeller drives the generator driven shaft to rotate so that the turbo-generator generates electric energy;

a compressor compartment water exit, in communication with the water spray nozzle disposed on the water drainage panel, so that the water flow is sprayed from the water spray nozzle;

an illumination means, accommodated in the housing chamber and electrically connected with the turbo-generator, so as to emit light beams.

In the showerhead with a turbocharger mechanism, the turbo-generator is disposed at a position near the case water inlet port, and includes a generator and a generator protective cover, wherein a protective cover water passage is disposed on the generator protective cover, and the generator protective cover protrudes backward so as to accommodate the generator therein and rests against a circumferential wall of the housing chamber.

In the showerhead with a turbocharger mechanism, the compressor compartment further includes a compartment upper body, and a compartment lower lid detachably covered on a bottom of the compartment upper body, so as to define a compartment chamber therein to accommodate the turbo-pump impeller, wherein a compressor compartment water inlet port in communication with the case water inlet port is disposed on the compartment upper body; a centrifugal passage with a diameter of cross-section gradually reduced from the compressor compartment water inlet port to the compressor compartment water exit is disposed on the bottom of the compartment upper body, for guiding the water flow coming from the compressor compartment water inlet port, and the centrifugal passage includes an inner wall on which a plurality of inclined intakes tangential to a moving direction of the water flow is disposed which allows a portion of the water flow to enter in a direction tangential to the rotation direction of the turbo-pump impeller, so that the intake water entering from the inclined intakes generate continuous tangential pressure along a circular centrifugal passage to generate the vortex flow; a compartment lower recess capable of accommodating the turbo-pump impeller is disposed at the bottom of the compartment lower lid, and a compressor compartment water exit is disposed at the bottom of the compartment lower recess.

In the showerhead with the turbocharger mechanism, the illumination means further includes a circuit board and a circuit electrically connected to the turbo-generator; the circuit has a plurality of light-emitting tubes arranged on a lower surface of the circuit board at intervals, so as to emit the light beams, and the circuit board is provided with a circuit board water hole.

In the showerhead with the turbocharger mechanism, a water passage sleeve pipe is disposed on the compartment upper body, and extends upward from the compartment upper body to be inserted into the protective cover water passage disposed on the generator protective cover, and the water passage sleeve pipe and the protective cover water passage are fitted hermetically, so as to ensure that the water flow is directly injected into the compartment chamber.

In the showerhead with the turbocharger mechanism, a sealing gasket is further provided, and the sealing gasket is provided between the turbo-generator and the turbo-pump unit, so as to ensure a complete sealing between the turbo-generator and the turbo-pump unit to avoid the generator from being affected with damp.

In the showerhead with the turbocharger mechanism, a protective cover wire through hole, a compartment upper wire through hole, and a compartment lower wire through hole are respectively disposed on the generator protective cover, the compartment upper body, and the compartment lower lid.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
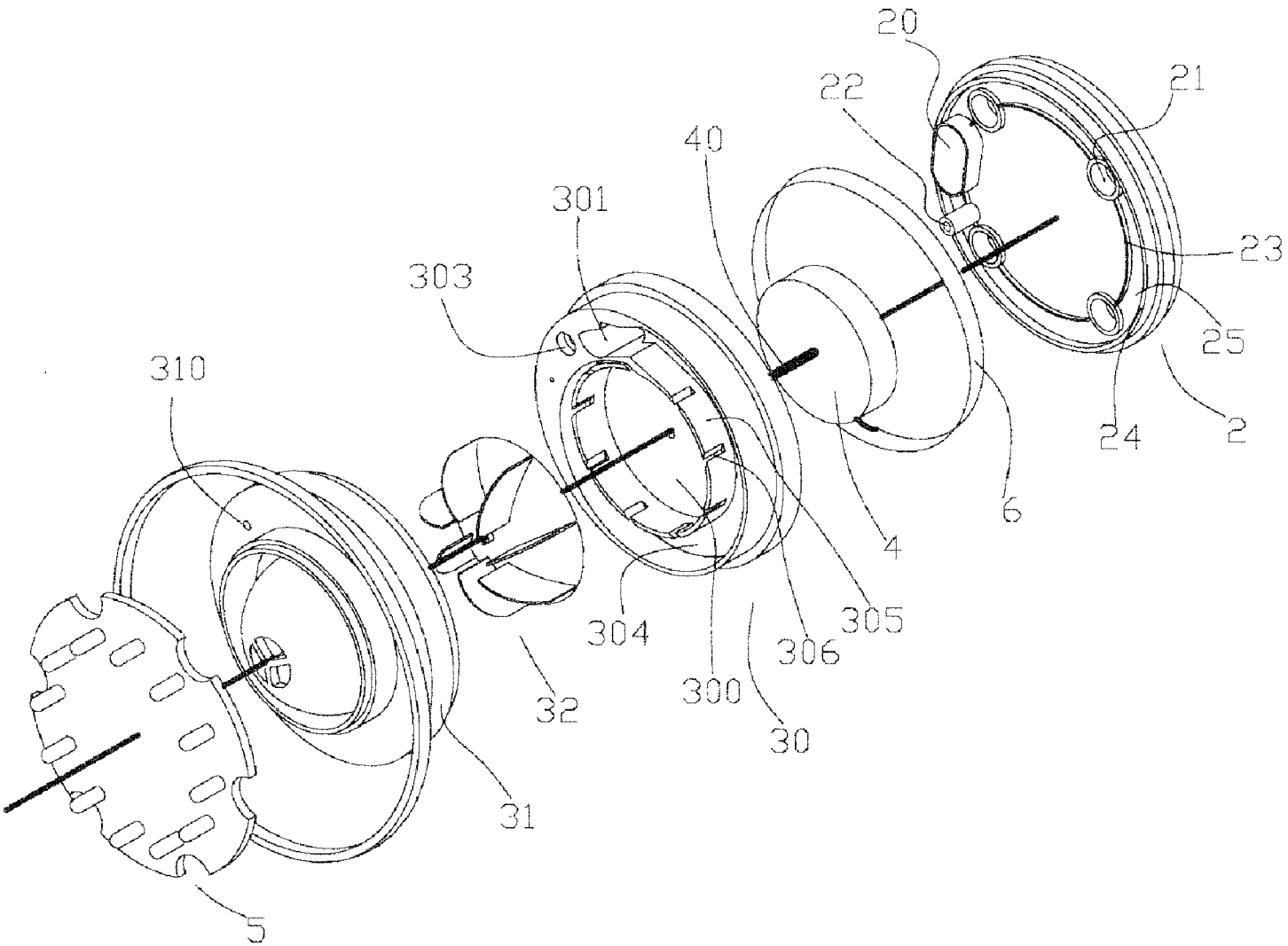
FIG. 1 is an exploded perspective view of a showerhead according to a preferred embodiment of the present invention, illustrating a turbo-pump unit, a generator, and an illumination means.

Referring to FIGS. 1-12, a showerhead according to a preferred embodiment of the present invention is illustrated. The showerhead includes a showerhead housing 10. The showerhead housing 10 has a water inlet port 100 for introducing a water flow, a case wall 101 that gradually expands and extends from the water inlet port 100 to define a housing chamber 102; and a water drainage panel 11, provided coaxially with the water inlet port 100, for ending the housing chamber 102.

Moreover, the showerhead of the present invention includes a turbo-compressor unit accommodated in the housing chamber 102. The turbo-compressor unit includes a compressor compartment 300 formed by a compartment upper body 30 and a compartment lower lid 31, and in communication with the water inlet port 100 for converting the water flow into a vortex flow; and a turbo-pump impeller 32, rotatably accommodated in the compressor compartment 300 to be driven by the vortex flow.

The showerhead further includes a turbo-generator 4 provided in the housing chamber 102 at a position near the turbo-compressor unit. The turbo-generator 4 includes a driven shaft 40 that extends from the turbo-generator 4 and is coaxially connected to the turbo-pump impeller 32 when the turbo-pump impeller 32 is driven by the vortex flow and starts to rotate to force the driven shaft 40 to rotate such that the turbo-generator functions to generate electric energy.

Moreover, the showerhead of the present invention further includes an illumination means 5 accommodated in the housing chamber 102 and electrically connected with the turbo-generator 4 to emit light beams.

Figure 2:
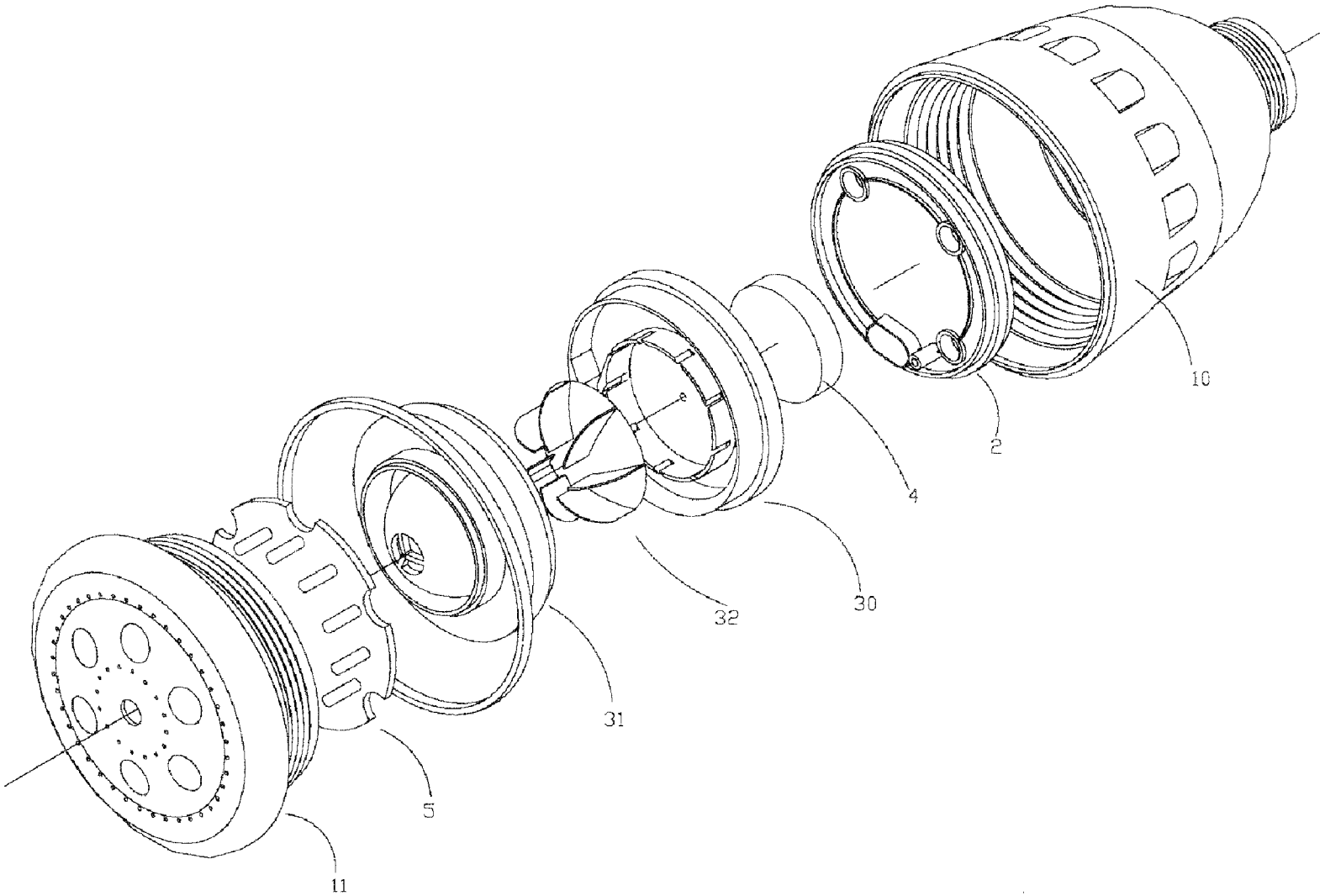
FIG. 2 is an exploded perspective view of a showerhead according to the embodiment of the present invention, illustrating a water inlet port, a showerhead case wall, and a water drainage panel.

Therefore, the showerhead of the present invention is provided for effectively converting the water flow into a high-pressure water flow, so as to make the turbo-generator rotate to start operation. As shown in FIG. 2, the turbo-compressor unit is configured to act as a centrifugal pump for compressing water flow. First, the water flow is introduced into the compressor compartment 300 to be converted into the vortex flow, and the vortex flow then drives the turbo-pump impeller 32 to rotate. Meanwhile, the vortex flow with a high pressure is jetted through the water drainage panel 11.

Referring to FIG. 2 and FIG. 11, a plurality of nozzles 110 is defined on the water drainage panel 11. Therefore, the water drainage panel 11 functions as a plurality of water exits in fluid communication with the turbo-compressor unit and the water inlet port 100.

In the preferred embodiment of the present invention, the turbo-generator 4 is provided at a position near the water inlet port 100. In addition to the driven shaft 40, the turbo-generator 4 further includes a generator protective cover 2 correspondingly fitted with the circumferential wall of the housing chamber 102. It should be noted that a generator rotor is mounted on the driven shaft 40. Therefore, as long as the driven shaft 40 is rotating, the rotor rotates with respect to a stator of the turbo-generator 4 to generate electricity.

Referring to FIGS. 2 and 3, the turbo-generator 4 further includes a water passageway 20 defined on the generator protective cover 2, and the water flow is directly injected in the compressor compartment 300 through the water passage, instead of leaking into the turbo-generator 4. As shown in FIG. 5, the turbo-pump impeller 32 acts as a water propeller of the turbo-compressor compartment 300. In the figure, 21 indicates a fixing hole, and 22 indicates a protective cover wire through hole.

Figure 3A:
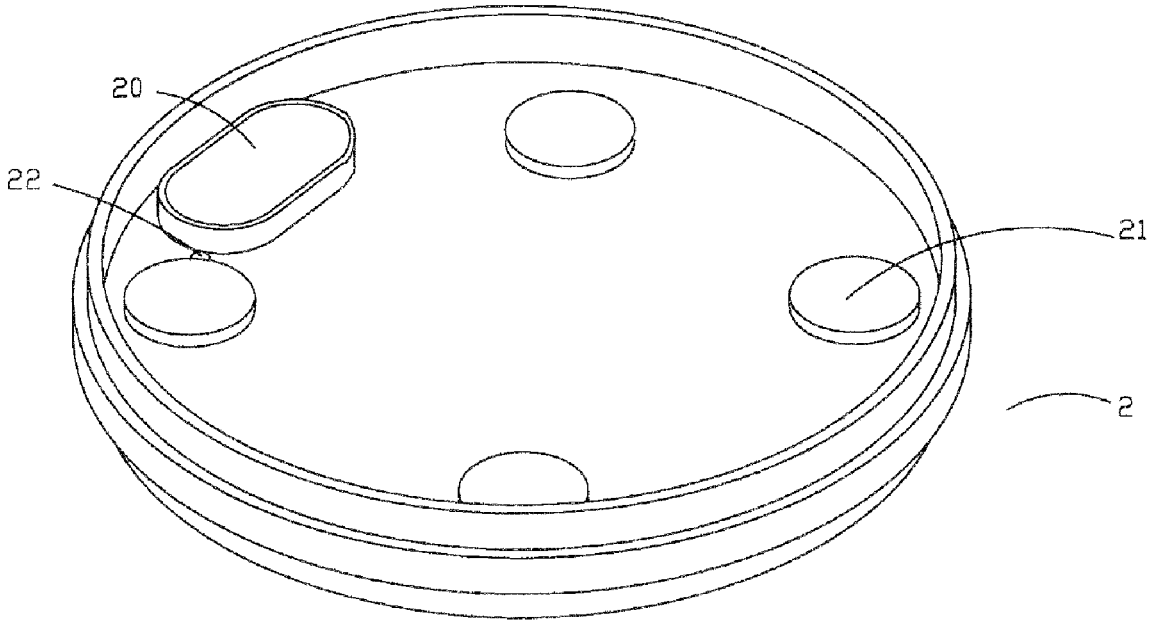
FIG. 3A is a perspective view of the top of the generator according to the preferred embodiment of the present invention.
Figure 3B:
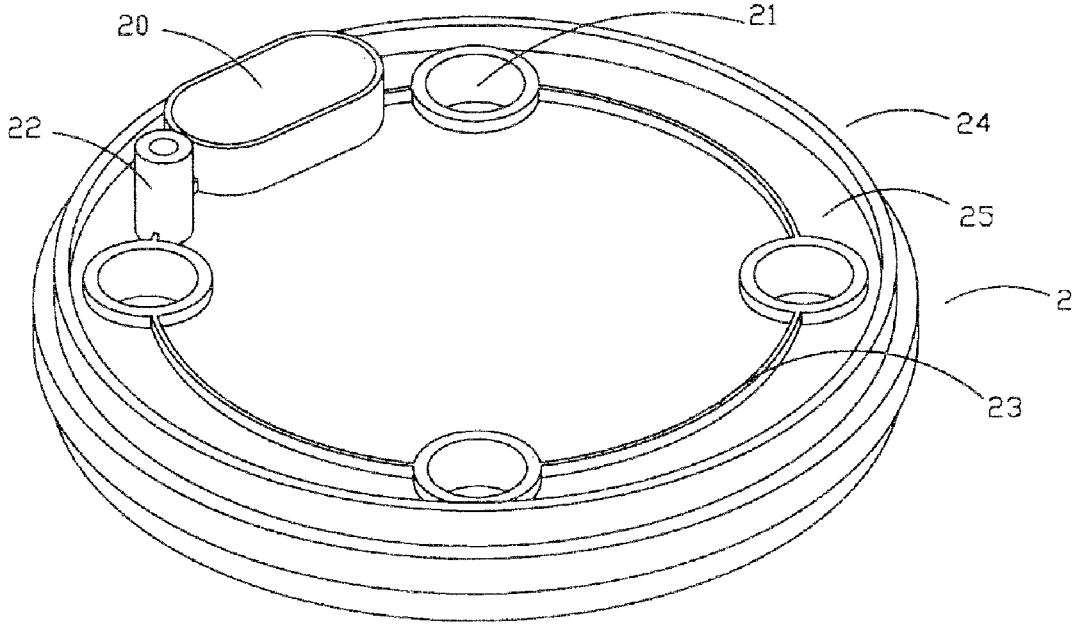
FIG. 3B is a perspective view of the bottom of the generator according to the preferred embodiment of the present invention.

FIGS. 3A and 3B illustrate the top and the bottom of the turbo-generator 4, respectively. In the generator protective cover 22 of the turbo-generator 4 according to the preferred embodiment of the present invention, the case wall 101 gradually expands from the water inlet port to define the housing chamber 102. Therefore, a chamber is reserved between the generator protective cover 2 and the water inlet port 100. Meanwhile, the generator protective cover 2 further includes a plurality of fixing, holes 21 defined on the lower surface of a peripheral edge of the generator protective cover 2, so as to be detachably fitted with the turbo-compressor unit. The generator protective cover 2 further includes a pair of circular flanges, namely an inner flange 23 and an outer flange 24 disposed at the peripheral edge of the generator protective cover 2, in which the inner flange 23 is lower than the outer flange 24. Therefore, the two circular flanges 23, 24 form a circular passageway 25 at the peripheral edge of the generator protective cover 2. It should be noted that the top of the turbo-compressor unit 3 is correspondingly fitted with the bottom of the generator protective cover 2, so as to ensure that the turbo-generator 4 is correspondingly fixed in the showerhead housing. Finally, the inner flange 23 extending from the generator protective cover 2 further includes the protective cover wife through holes 22 provided thereon for wires to pass through.

Figure 4A:
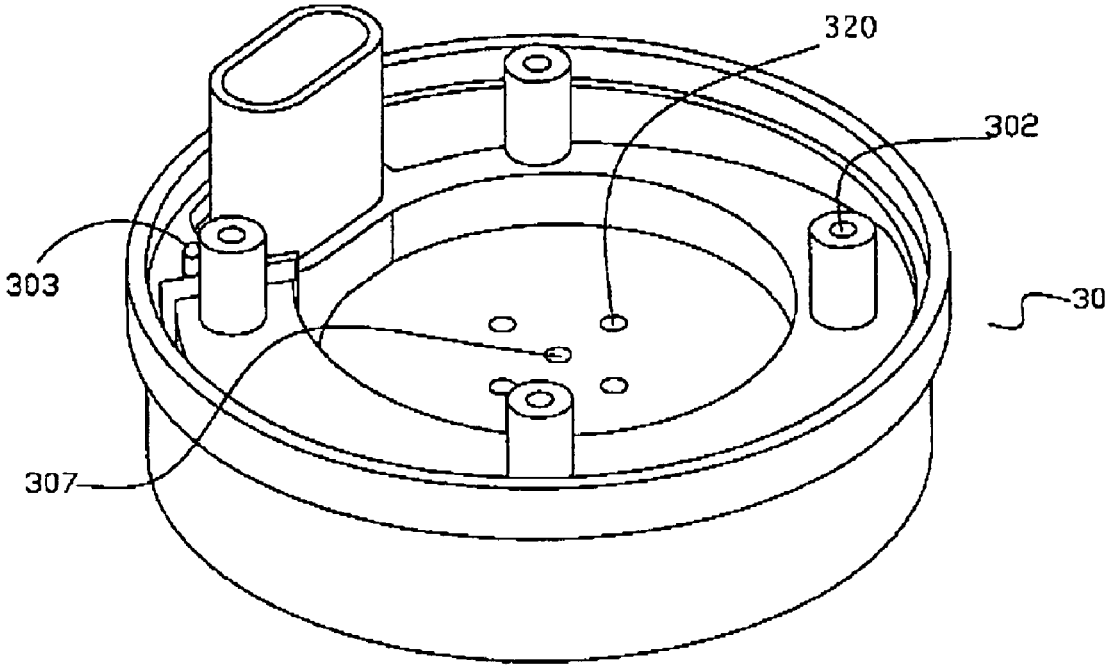
FIG. 4A is a perspective view of the top of a turbo-pump unit according to the preferred embodiment of the present invention.
Figure 4B:
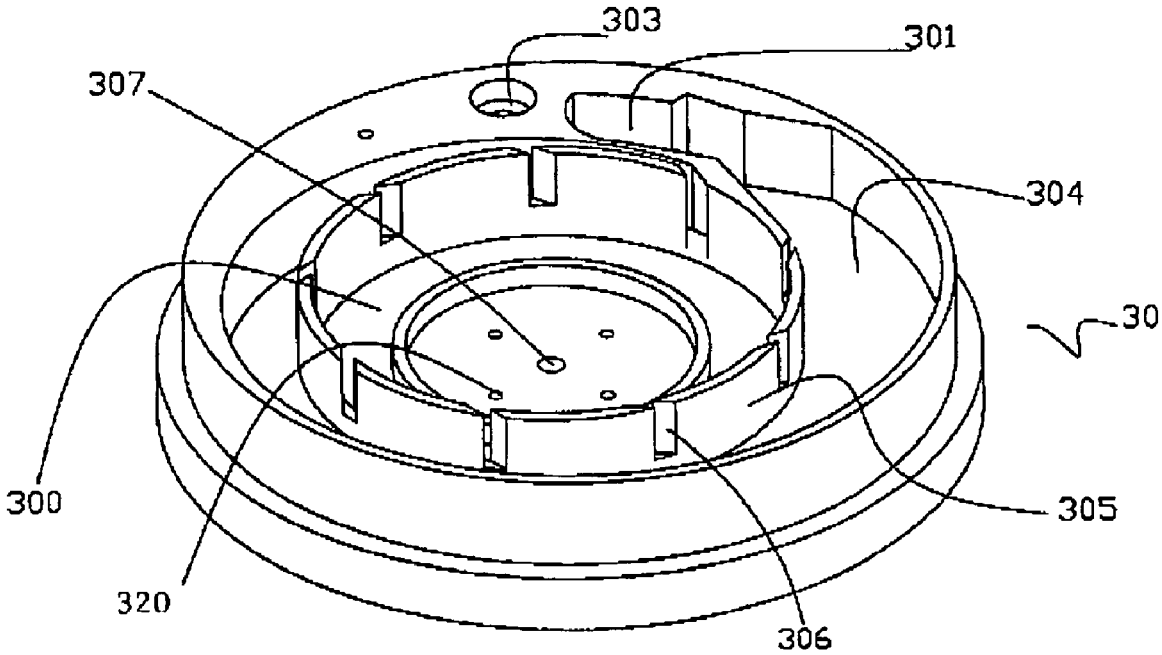
FIG. 4B is a perspective view of the bottom of the turbo-pump unit according to the preferred embodiment of the present invention.
Figure 5A:
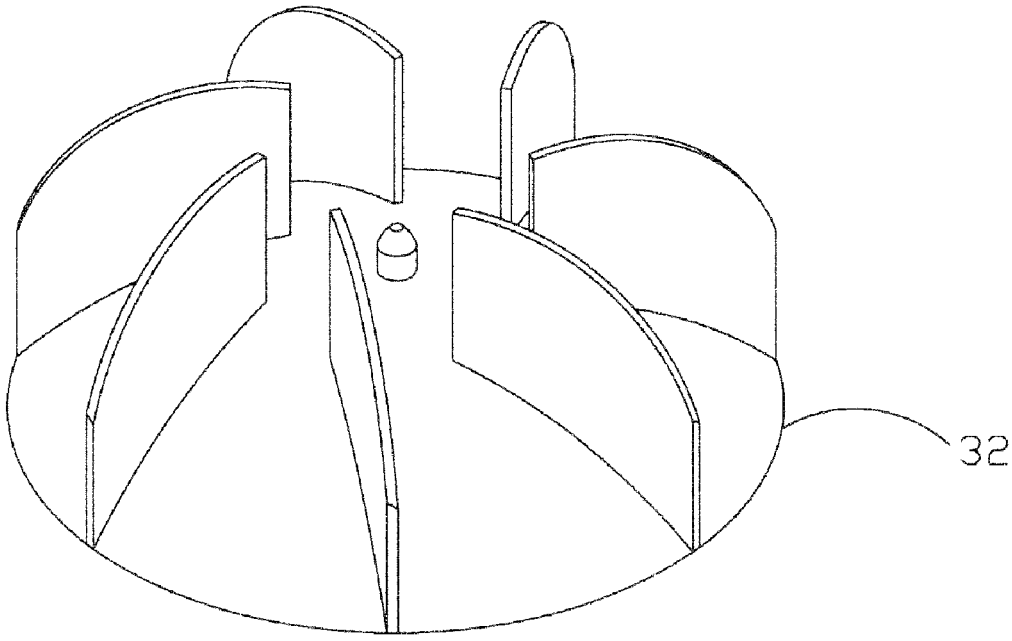
FIG. 5A is a perspective view of the turbo-pump impeller according to the preferred embodiment of the present invention.
Figure 5B:
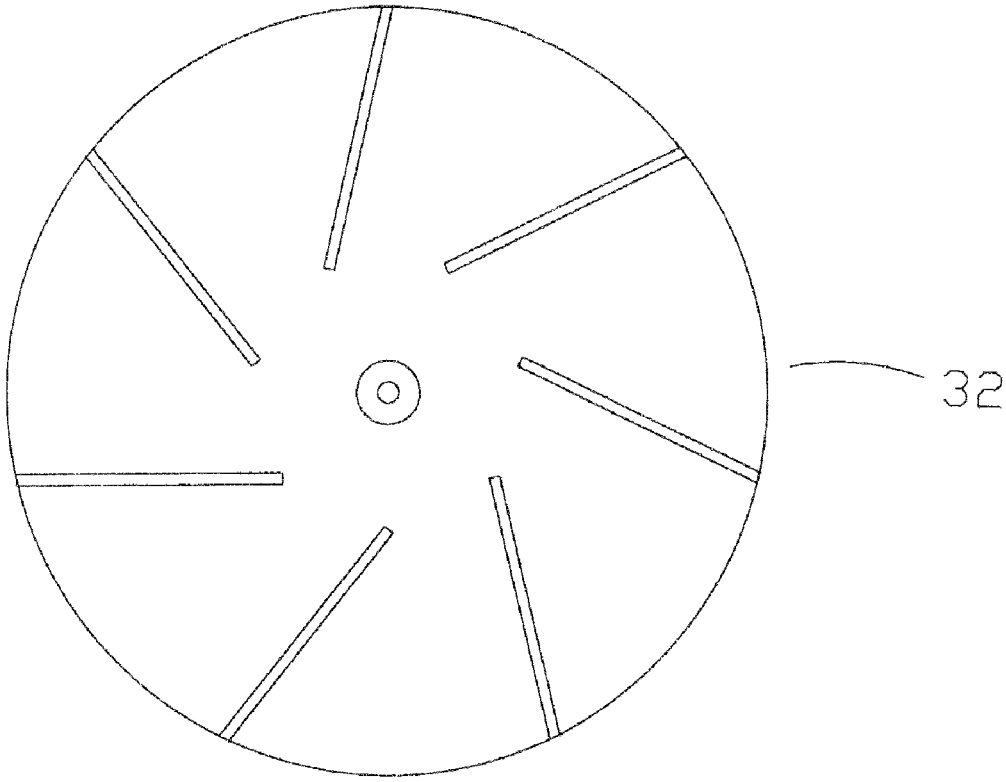
FIG. 5B is a bottom view of the turbo-pump impeller according to the preferred embodiment of the present invention.
Figure 6:
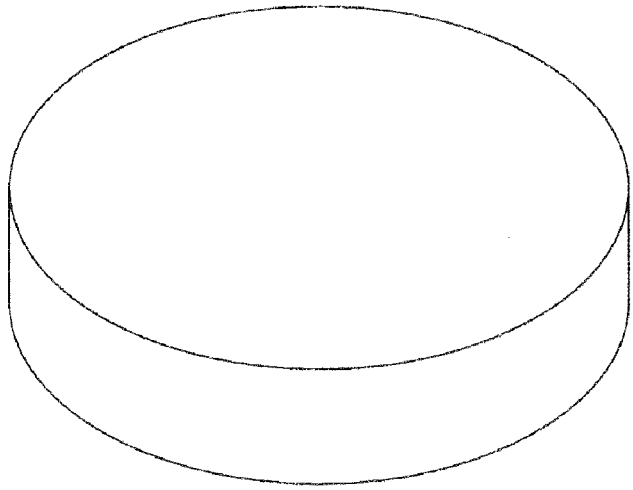
FIG. 6 is a schematic view of the generator according to the present invention.

FIGS. 4A, 4B, 5A, and 5B illustrate the top and the bottom of the turbo-compressor unit, respectively. According to the preferred embodiment of the present invention, the compressor compartment 300 includes a compartment upper body 30, and a compartment lower lid 31 detachably covered on the bottom of the compartment upper body 30, so as to define a compartment chamber 300 there between for accommodating the turbo-pump impeller 32. As shown in FIG. 4B, the profile of the bottom of the compartment upper body 30 is similar to that of the centrifugal pump, and the water flow is introduced along the boundary to generate continuous force in a tangential direction, so as to generate the vortex flow.

The compartment upper body 30 is round, and the compartment lower lid 31 is semispherical, thereby not only providing a cone space, but also supporting the turbo-pump impeller at a proper position. Therefore, the top of the compartment upper body 30 is configured to fit the lower surface of the generator protective cover 2, as shown in FIG. 2. That is to say, the compartment upper body 30 includes a water passage sleeve pipe 301 extending upward from the compartment upper body 30, so as to be inserted in the water passage 20 of the generator protective cover 2. Therefore, the water flow can be directly injected into the compartment chamber 300. The compartment upper body 30 further includes four mounting posts 302 extending upright from the compartment upper body, so as to be coupled with the corresponding fixing holes 21 of the generator protective cover 2. Therefore, the compartment upper body further includes compartment upper wire through holes 303 correspondingly fitted with the protective cover wire through holes 22 of the turbo-generator 4, in which the wires are adapted to pass through the protective cover wire through holes 22, the compartment upper wire through holes 303, and the compartment lower wire through hole 311, so as to electrically connect the turbo-generator 4 and the illumination means 5. It should be noted that the circumferential edge at the top of the compartment upper body 30 extends upright to form the circular flange, so as to be inserted into circular passage 25 defined on the bottom of the generator protective cover 2. This type of arrangement ensures that the turbo-compressor unit is fitted with the turbo-generator 4 during operation. In the figure, reference numeral 320 indicates a mounting hole for mounting the turbo-generator 4, 307 indicates a shaft hole fitted with the driven shaft 40. The driven shaft 40 penetrates through the hole to be connected to the turbo-pump impeller 32, and a water-proof treatment is performed between the driven shaft 40 and the shaft hole 307.

As shown in FIG. 4B, the bottom of the compartment upper body 30 is constructed to be a centrifugal pump having a centrifugal passage 304 for introducing the water flow, in which an inner wall 305 of the centrifugal passage 304 has a plurality of inclined intakes 306 tangential to the moving direction of the water flow disposed thereon, so as to form a plurality of deflected intervals each between two neighboring inclined intakes 306. Moreover, the size of the cross-section of the centrifugal passage 304 is gradually reduced, so as to form a vortex flow passage for guiding the water flow. As the size of the circular centrifugal passage 304 becomes narrow gradually, the water flowing through the passage will be subjected to a gradually increasing pressure, and then extruded into the compartment chamber 300 through the plurality of inclined intakes, such that the turbo-pump impeller 32 rotatably supported by the compartment lower lid 31 rotates. It should be noted that the water flow is guided into a wide most portion of the centrifugal passage 304, and then guided into the compartment chamber 300 along the centrifugal passage 304. Therefore, the compressed water is concentrated at a central portion of the centrifugal pump.

According to the preferred embodiment of the present invention, each of the inclined intakes 306 is particularly designed to have a predetermined inclined angle. That is to say, each inclined angle of the inclined water gap 306 is gradually increased along the circular centrifugal passage 304 especially. Meanwhile, the interval between every two neighboring inclined intakes 306 is gradually reduced. It should be noted that this type of arrangement is directed to generating a vortex flow effect inside the compressor compartment chamber 300. The compartment lower lid 31 is conical, and has a base slot for the turbo-pump impeller 32 to inserted, and the shape of the turbo-pump impeller 32 is similar to a thruster for enhancing rotation effect.

This structure can be clearly seen in FIG. 4. The right side of the centrifugal passage 304 is wider and higher than the left side opposite to the right side. The water flow is injected from the right side of the centrifugal passage 304, and is guided to the left side of the centrifugal passage 304. The gradually reduced space compresses the water, and extrudes the water to the central portion of the compressor compartment chamber 300.

Figure 7:
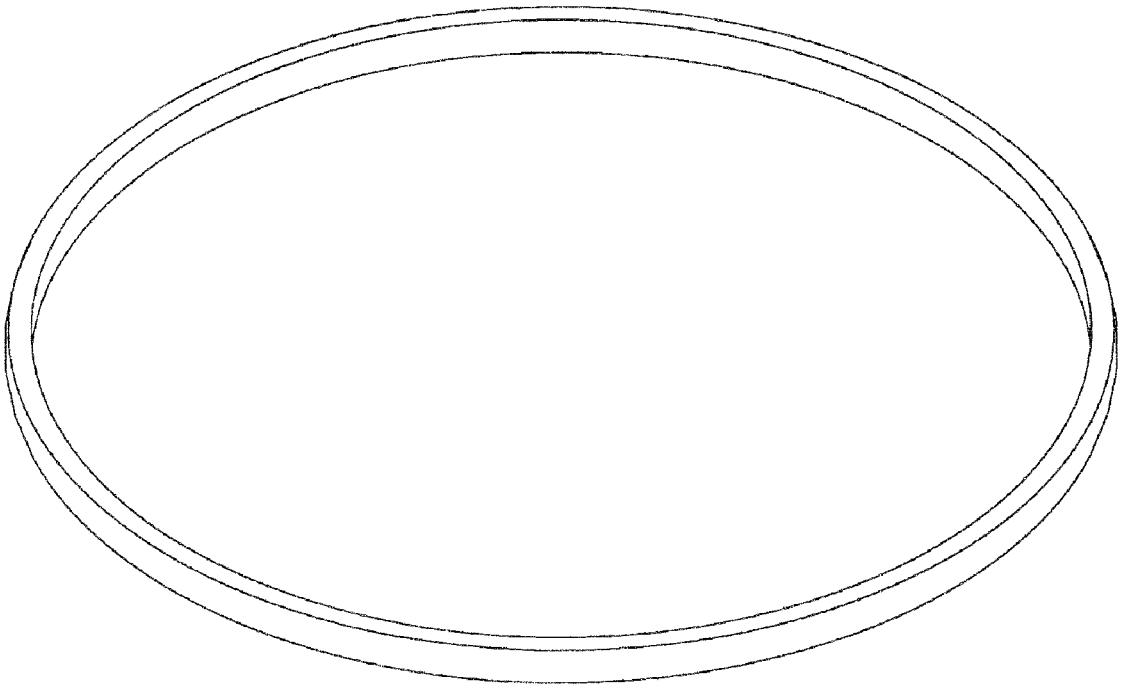
FIG. 7 is a perspective view of a sealing ring according to the preferred embodiment of the present invention.

As shown in FIG. 7, the showerhead of the present invention further includes a sealing gasket 6 for preventing water being communicated between the turbo-generator 4 and the turbo-compressor unit, and for protecting the turbo-compressor unit in a waterproof manner. The sealing gasket 6 is prepared by a resin material. It should be noted that the sealing gasket will ensure that the water sprayed from the turbo-compressor unit will not leak into the showerhead housing 10.

Figure 8A:
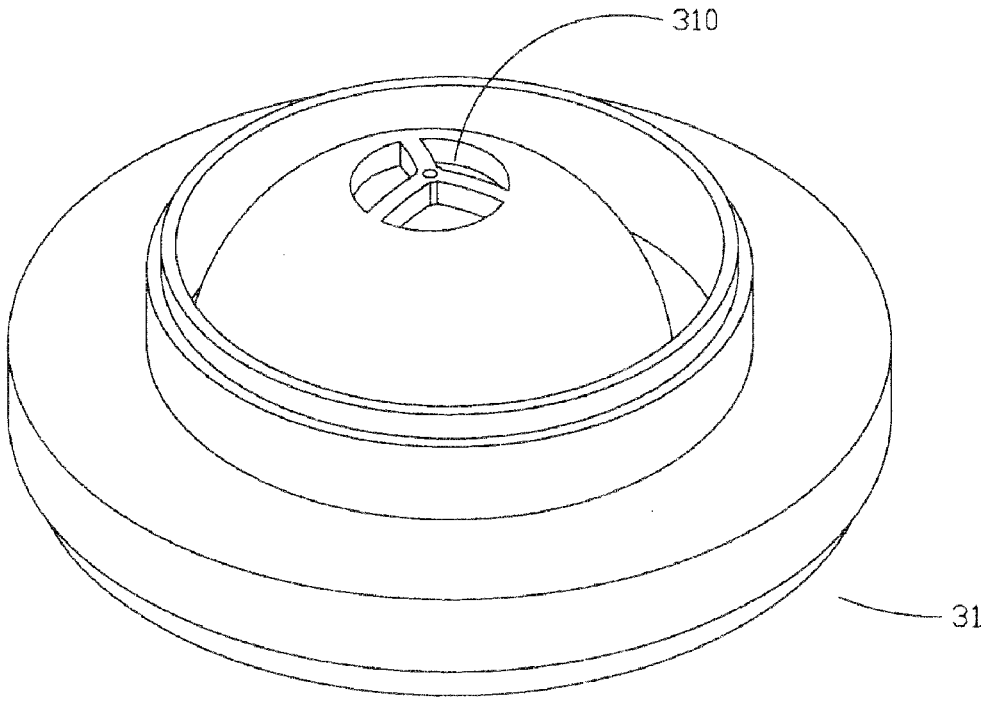
FIG. 8A is a perspective view of the bottom of the turbo-pump unit according to the preferred embodiment of the present invention.
Figure 8B:
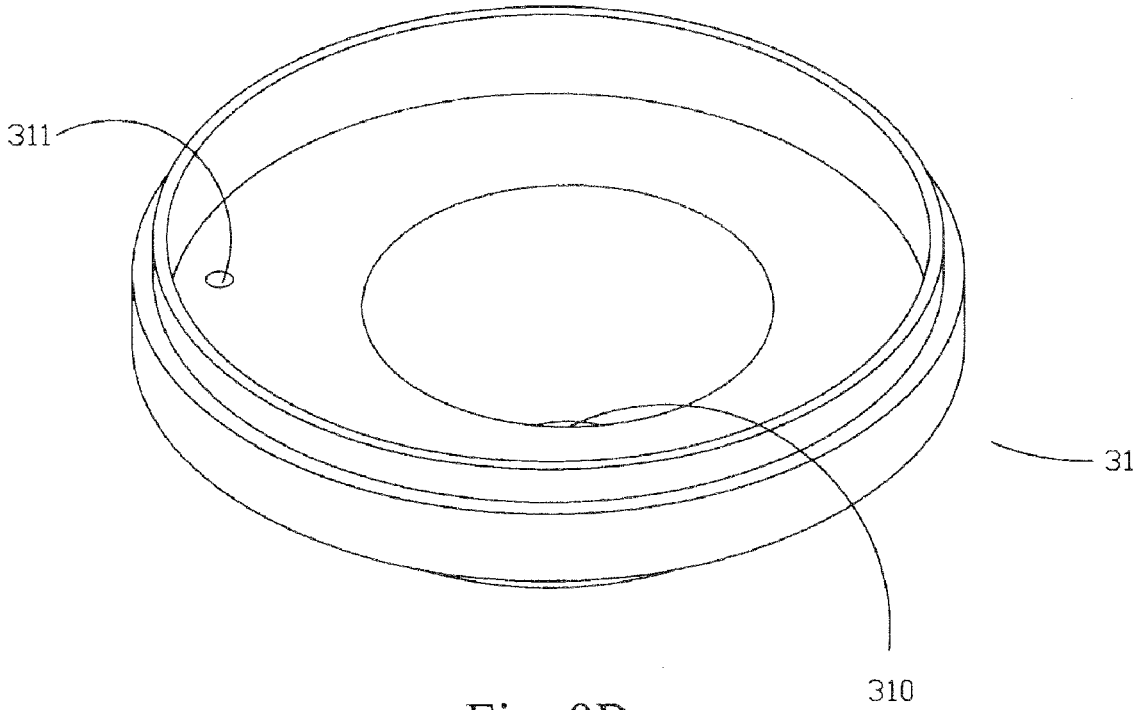
FIG. 8B is a perspective view of base components of the turbo-pump unit according to the preferred embodiment of the present invention.

As shown in FIG. 8, a compressor compartment water exit 310 is further defined at the bottom of the compartment lower lid 31, in which the compressor compartment water exit 310 can include three semi-sector shaped through holes, each of them is semi-sector shaped for effectively spraying the water flow because the fact that three semi-sector shaped compressor compartment water exit 310 can form a relatively round hole in practice. It should be noted that the main shaft of the turbo-pump impeller 32 further extend downward to enhance the rotation movement of the turbo-pump impeller 32.

According to the present invention, the illumination means 5 further includes a circuit board 50 having a circular edge fitted with the inner surface of the housing body; and a plurality of light-emitting tubes 51 arranged on the lower surface of the circuit board 50 at intervals for emitting light beams.

Figure 9A:
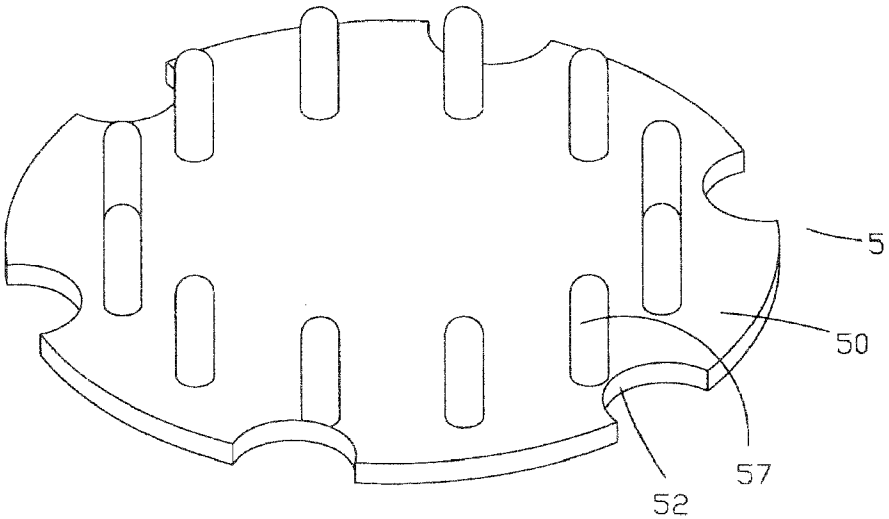
FIG. 9A is a perspective view of an upper surface of the illumination means according to the preferred embodiment of the present invention.
Figure 9C:
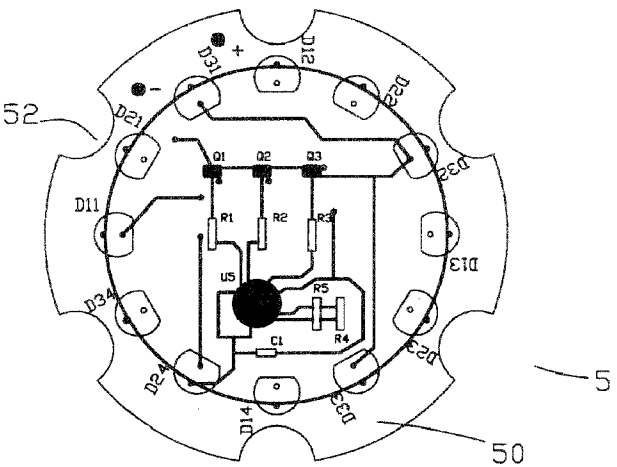
FIG. 9C is a schematic view of a circuit board of the illumination means according to the preferred embodiment of the present invention.
Figure 9B:
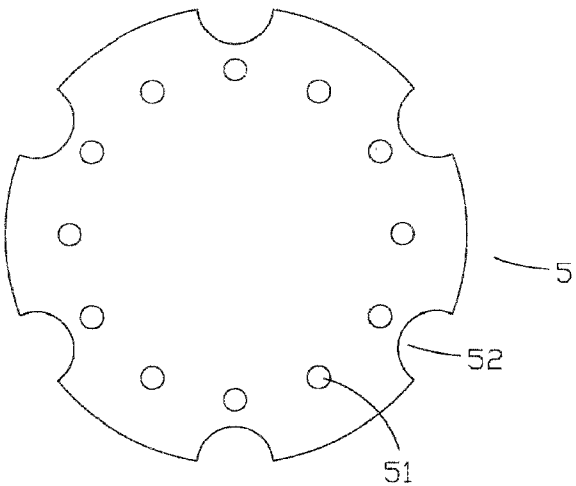
FIG. 9B is a perspective view of a lower surface of the illumination means according to the preferred embodiment of the present invention.
Figure 10A:
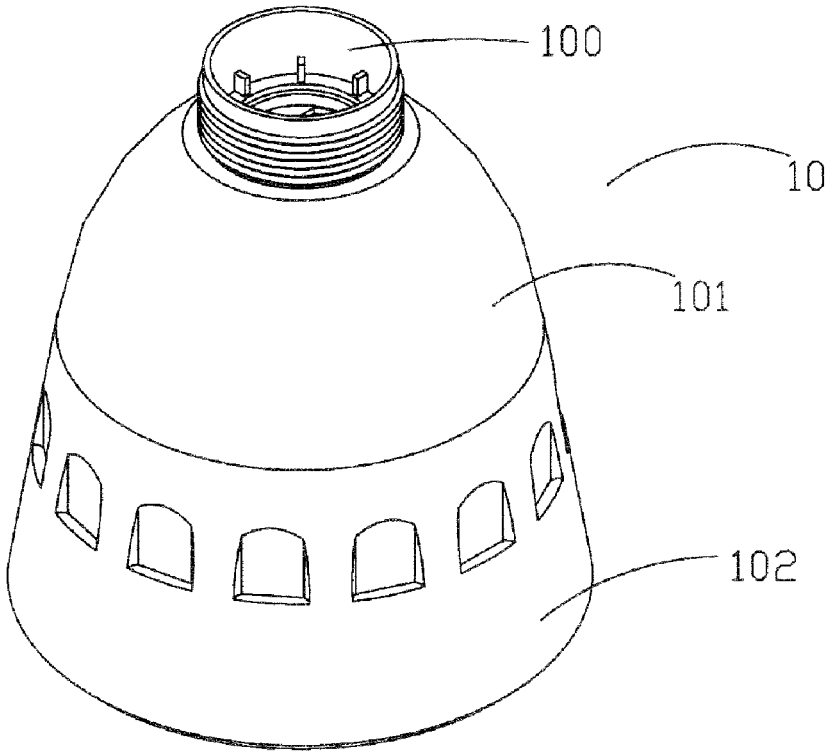
FIG. 10A is a perspective view of a showerhead housing according to the preferred embodiment of the present invention, illustrating a plurality of cuts provided on a main body of the showerhead for illumination.
Figure 10B:
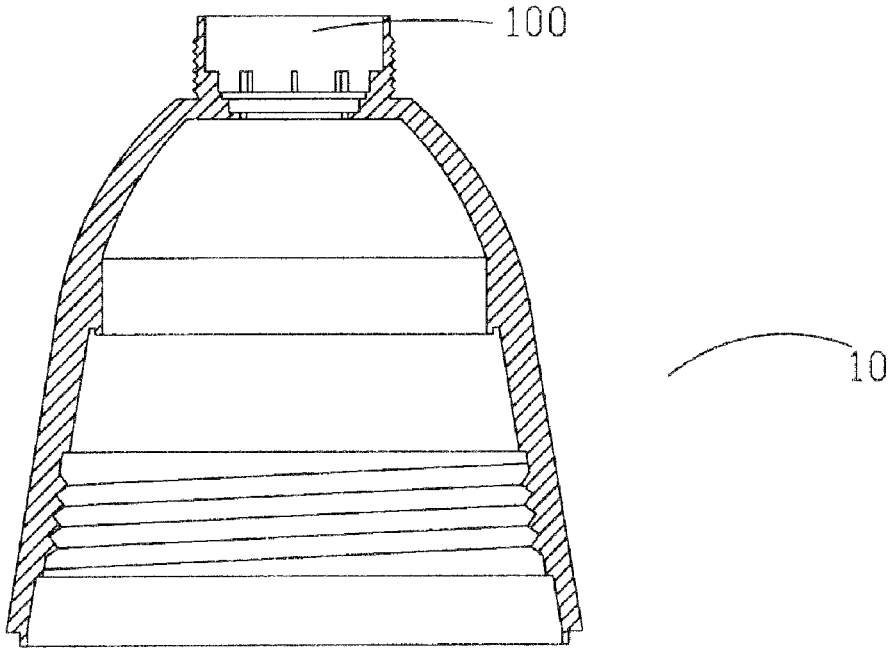
FIG. 10B is a cross-sectional view of the showerhead housing according to the preferred embodiment of the present invention.

FIG. 9C illustrates the circuit board 50 of the illumination means 5 electrically connected with the turbo-generator 4, so as to provide power supply to the light-emitting tubes 51. Therefore, the light-emitting tubes 51 can be configured to have different colors, so as to establish different emitting effects. As the electricity is controlled by the rotating speed of the turbo-pump impeller 32, the user can selectively adjust the brightness of the light-emitting tubes by managing the water flow intensity. Circuit board water holes 52 are symmetrically disposed at sides of the illumination means 5. In practical application, a water-proof treatment, such as water-proof adhesive sealing, is performed on the naked conductive portions of the circuit board 50 of the illumination means 5.

Figure 12:
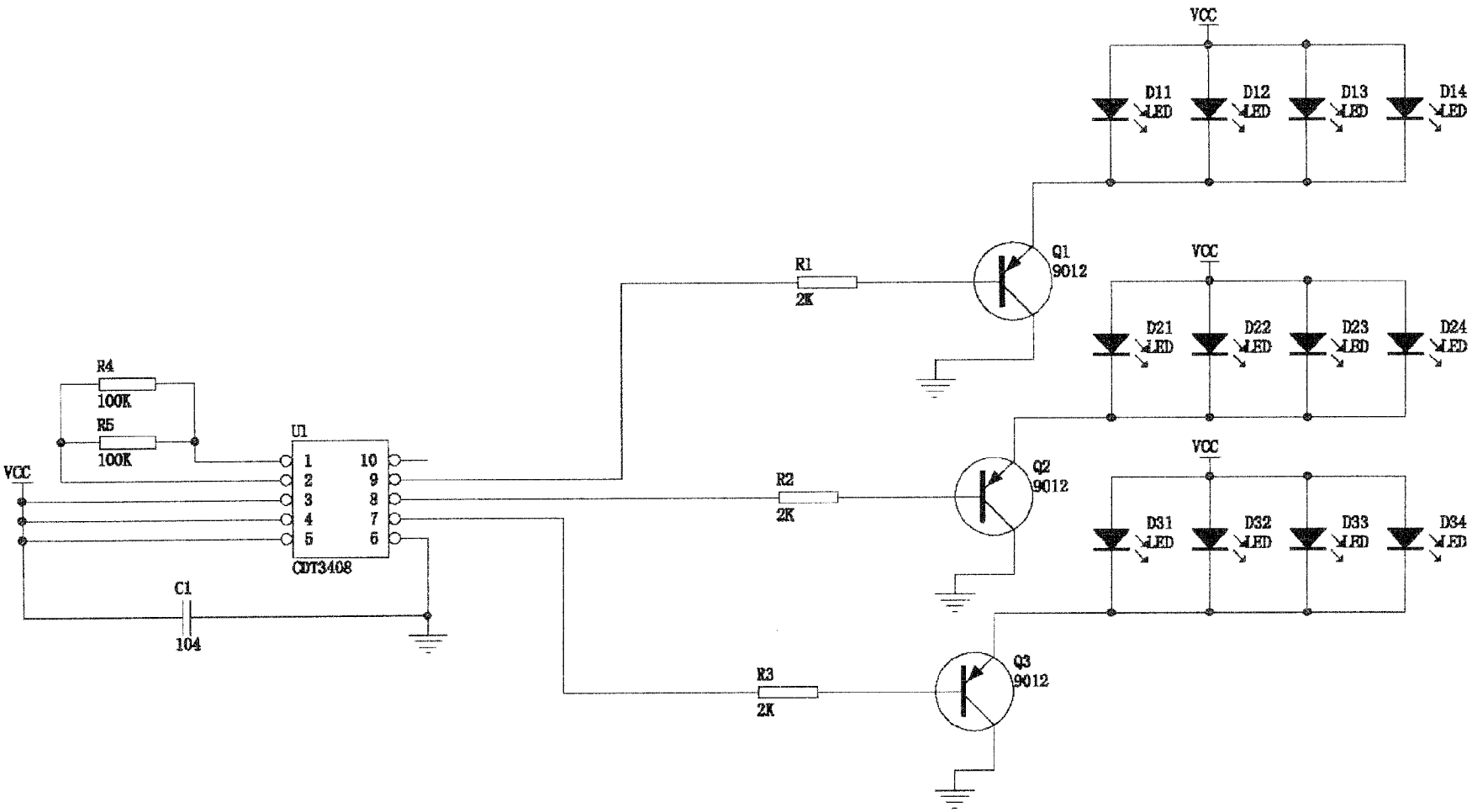
FIG. 12 is a circuit diagram of an illumination circuit board according to the preferred embodiment of the present invention.

As shown in FIG. 12, resistors R1,R2,R3,R4,R5 are regulating resistors, capacitor C1 is a regulating capacitor, audions Q1,Q2,Q3 are conductive tubes, and D11-D14,D21-D24, D31-D34 are light-emitting diodes (i.e., light-emitting tubes 51).

Figure 11A:
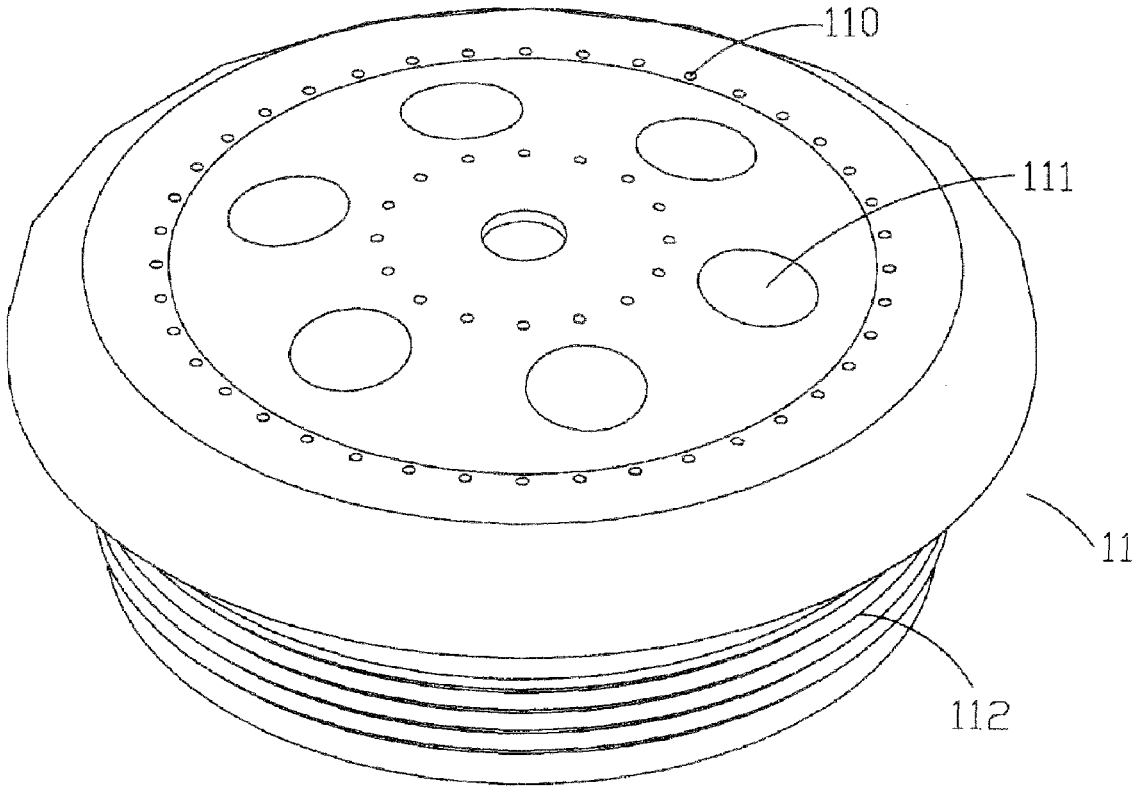
FIG. 11A is a perspective view of the water drainage panel according to the preferred embodiment of the present invention.
Figure 11B:
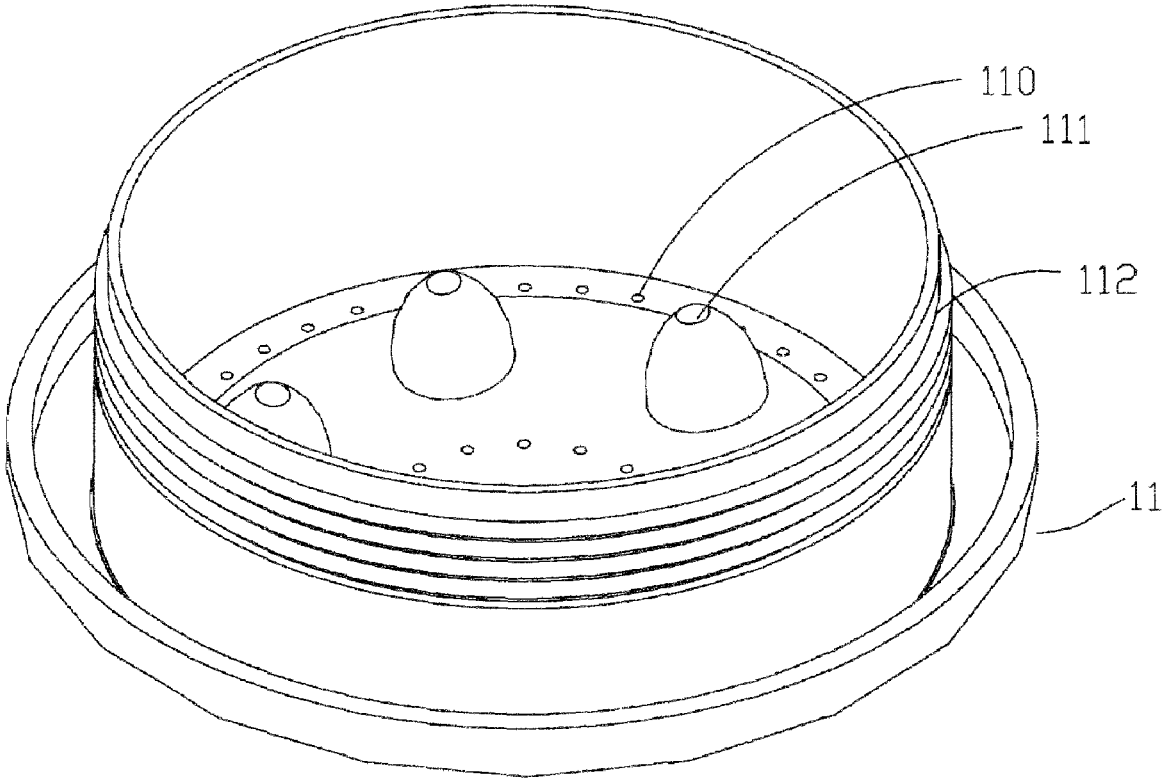
FIG. 11B is another perspective view of the water drainage panel according to the preferred embodiment of the present invention.

Referring to FIG. 11A and FIG. 11B, the water drainage panel 11 according to the preferred embodiment of the present invention is illustrated. The water drainage panel 11 further includes a threaded wall 112 extending in turns from the water drainage panel 11, so as to rotatably attach the water drainage panel 11 to the housing chamber 102. The water drainage panel 11 is further provided with a water spray nozzle 110 and a light-emitting tube light uniform head 111.

The invention being thus described, it will be obvious that the same may be varied in many ways. Such variations are not to be regarded as a departure from the spirit and scope of the invention and all such modifications as would be obvious to one skilled in the art are intended to be included within the scope of the following claims.

What is claimed is:

1. A showerhead with a turbocharger mechanism, the showerhead comprising:

a showerhead housing, comprising a case and a water drainage panel, wherein the case has a case water inlet port for introducing a water flow, and a case wall that gradually expands; the water drainage panel has a water spray nozzle disposed thereon and is disposed at a most bottom end of the case and hermetically connected with the case;

a turbo-compressor unit, accommodated in a housing chamber, wherein the turbo-compressor unit comprises:

a compressor compartment, having a compressor compartment water inlet port communicated with the case water inlet port, so as to convert the water flow into a vortex flow to push a turbo-pump impeller, so that the water is discharged from a compressor compartment water exit; and the turbo-pump impeller, rotatably accommodated in the compressor compartment;

a turbo-generator, provided in the housing chamber, and comprising a generator and a generator driven shaft coaxially connected to the turbo-pump impeller; wherein when the turbo-pump impeller is driven by the vortex flow, the turbo-pump impeller drives the generator driven shaft to rotate so that the turbo-generator generates electric energy;

the compressor compartment water exit, in communication with the water spray nozzle disposed on the water drainage panel, so that the water flow is sprayed from the water spray nozzle; and an illumination means, accommodated in the housing chamber and electrically connected with the turbo-generator, so as to emit light beams, wherein the compressor compartment further comprises a compartment upper body, and a compartment lower lid detachably covered on a bottom of the compartment upper body, so as to define a compartment chamber therein to accommodate the turbo-pump impeller, wherein the compressor compartment water inlet port in communication with the case water inlet port is disposed on the compartment upper body; a centrifugal passage with a diameter of cross-section gradually reduced from the compressor compartment water inlet port to the compressor compartment water exit is disposed on the bottom of the compartment upper body, for guiding the water flow coming from the compressor compartment water inlet port, and the centrifugal passage comprises an inner wall on which a plurality of inclined intakes tangential to a moving direction of the water flow is disposed which allows a portion of the water flow to enter in a direction tangential to the rotation direction of the turbo-pump impeller, so that the intake water entering from the inclined intakes generate continuous tangential pressure along a circular centrifugal passage to generate the vortex flow; a compartment lower recess capable of accommodating the turbo-pump impeller is disposed at the bottom of the compartment lower lid, and the compressor compartment water exit is disposed at the bottom of the compartment lower recess.

2. A showerhead with a turbocharger mechanism, the showerhead comprising:

a showerhead housing, comprising a case and a water drainage panel, wherein the case has a case water inlet port for introducing a water flow, and a case wall that gradually expands; the water drainage panel has a water spray nozzle disposed thereon and is disposed at a most bottom end of the case and hermetically connected with the case;

a turbo-compressor unit, accommodated in a housing chamber, wherein the turbo-compressor unit comprises:

a compressor compartment, having a compressor compartment water inlet port communicated with the case water inlet port, so as to convert the water flow into a vortex flow to push a turbo-pump impeller, so that the water is discharged from a compressor compartment water exit; and the turbo-pump impeller, rotatably accommodated in the compressor compartment;

a turbo-generator, provided in the housing chamber, and comprising a generator and a generator driven shaft coaxially connected to the turbo-pump impeller; wherein when the turbo-pump impeller is driven by the vortex flow, the turbo-pump impeller drives the generator driven shaft to rotate so that the turbo-generator generates electric energy;

the compressor compartment water exit, in communication with the water spray nozzle disposed on the water drainage panel, so that the water flow is sprayed from the water spray nozzle; and an illumination means, accommodated in the housing chamber and electrically connected with the turbo-generator, so as to emit light beams, wherein the illumination means further comprises a circuit board and a circuit electrically connected to the turbo-generator; the circuit has a plurality of light-emitting tubes arranged on a lower surface of the circuit board at intervals, so as to emit the light beams, and the circuit board is provided with a circuit board water hole.

3. The showerhead with a turbocharger mechanism as claimed in claim 2, wherein the turbo-generator comprises a generator protective cover, wherein a protective cover water passage is disposed on the generator protective cover; and wherein a water passage sleeve pipe is disposed on a compartment upper body of the compressor compartment, and extends upward from the compartment upper body to be inserted into the protective cover water passage disposed on the generator protective cover, and the water passage sleeve pipe and the protective cover water passage are fitted hermetically, so as to ensure that the water flow is directly injected into the compartment chamber.

4. The showerhead with a turbocharger mechanism as claimed in claim 3, further comprising a sealing gasket, wherein the sealing gasket is provided between the turbo-generator and a turbo-pump unit, so as to ensure a complete sealing between the turbo-generator and the turbo-pump unit to avoid the generator from being affected with damp.

5. A showerhead with a turbocharger mechanism, the showerhead comprising:

a showerhead housing, comprising a case and a water drainage panel, wherein the case has a case water inlet port for introducing a water flow, and a case wall that gradually expands; the water drainage panel has a water spray nozzle disposed thereon and is disposed at a most bottom end of the case and hermetically connected with the case;

a turbo-compressor unit, accommodated in a housing chamber, wherein the turbo-compressor unit comprises:

a compressor compartment, having a compressor compartment water inlet port communicated with the case water inlet port, so as to convert the water flow into a vortex flow to push a turbo-pump impeller, so that the water is discharged from a compressor compartment water exit; and the turbo-pump impeller, rotatably accommodated in the compressor compartment;

a turbo-generator, provided in the housing chamber, and comprising a generator and a generator driven shaft coaxially connected to the turbo-pump impeller; wherein when the turbo-pump impeller is driven by the vortex flow, the turbo-pump impeller drives the generator driven shaft to rotate so that the turbo-generator generates electric energy;

the compressor compartment water exit, in communication with the water spray nozzle disposed on the water drainage panel, so that the water flow is sprayed from the water spray nozzle; and an illumination means, accommodated in the housing chamber and electrically connected with the turbo-generator, so as to emit light beams, wherein a protective cover wire through hole, a compartment upper wire through hole, and a compartment lower wire through hole are respectively disposed on a generator protective cover of the turbo-generator, a compartment upper body, and a compartment lower lid of the compressor compartment.

* * * * *